US008696380B2

(12) United States Patent
Su et al.

(10) Patent No.: US 8,696,380 B2
(45) Date of Patent: Apr. 15, 2014

(54) CABLE ASSEMBLY WITH REMOVABLE FASTENING MODULE

(75) Inventors: Ping-Sheng Su, New Taipei (TW); Hong-Lei Fan, Kunshan (CN); Fan-Bo Meng, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 220 days.

(21) Appl. No.: 13/233,019

(22) Filed: Sep. 15, 2011

(65) Prior Publication Data

US 2012/0064761 A1 Mar. 15, 2012

(30) Foreign Application Priority Data

Sep. 15, 2010 (CN) ..... 2010 2 0529963

(51) Int. Cl.
*H01R 13/58* (2006.01)

(52) U.S. Cl.
USPC ..... 439/606; 439/345; 439/362

(58) Field of Classification Search
USPC ..... 439/604, 606, 564, 570, 563, 573, 557, 439/552, 345, 357, 359, 362
See application file for complete search history.

(56) References Cited

U.S. PATENT DOCUMENTS

| | | | | |
|---|---|---|---|---|
| 5,401,189 | A * | 3/1995 | Sato | 439/345 |
| 6,116,941 | A * | 9/2000 | Kuo | 439/357 |
| 6,648,676 | B1 | 11/2003 | Lee | |
| 6,783,389 | B1 | 8/2004 | Lee | |
| 2010/0009569 | A1 * | 1/2010 | Su et al. | 439/552 |

* cited by examiner

*Primary Examiner* — Felix O Figueroa
(74) *Attorney, Agent, or Firm* — Wei Te Chung; Ming Chieh Chang

(57) ABSTRACT

An electrical connector includes an insulative housing, a plurality of contacts mounted in the insulative housing and a pair of fastening modules assembled to the insulative housing. The insulative housing forms a main base with a mating portion and a holder portion defined on the main base. Each fastening module includes a securing base assembled to the holder portion of the main base and a fastening member assembled with the securing base.

11 Claims, 9 Drawing Sheets

CABLE ASSEMBLY WITH REMOVABLE FASTENING MODULE

BACKGROUND OF THE INVENTION

1. Field of the Invention

The present invention generally relates to a cable assembly, and more particularly to a cable assembly with a removable fastening module.

2. Description of Related Art

Computers are widely used in different fields today and interfaces of cable connector used therein are standardized for compatibility. In industrial application, people may use a cable connector directly as data cable or mount a cable connector onto a mounting face as a sub-component of a base. U.S. Pat. No. 6,648,676 issued to Lee on Nov. 18, 2003 discloses a cable connector housing mounted behind a panel comprising a standardized interface integrated with a fastening module. We can also see another cable connector disclosed in U.S. Pat. No. 6,783,389 issued to Lee on Aug. 31, 2004 comprising a cable connector housing without a fastening module being held to insert into a complementary receptacle. The total connector structures in these two applications are basically the same except for an additional fastening module in the former one and manufacturers have to set up two different housing moulds according to these small differences.

Hence, an improved cable assembly with a removable fastening module is desired to overcome the above problems.

BRIEF SUMMARY OF THE INVENTION

Accordingly, the object of the present invention is to provide a cable assembly with a removable fastening module, which can be sharely used in cable or component applications.

In order to achieve the above-mentioned object, a cable assembly in accordance with the present invention includes an insulative housing, a plurality of contacts mounted in the insulative housing and a pair of fastening modules assembled to the insulative housing. The insulative housing forms a main base with a mating portion and a holder portion defined on the main base. Each fastening module includes a securing base assembled to the holder portion of the main base and a fastening member assembled with the securing base.

Other objects, advantages and novel features of the invention will become more apparent from the following detailed description of the present embodiment when taken in conjunction with the accompanying drawings.

DETAILED DESCRIPTION OF THE INVENTION

Figure 1:
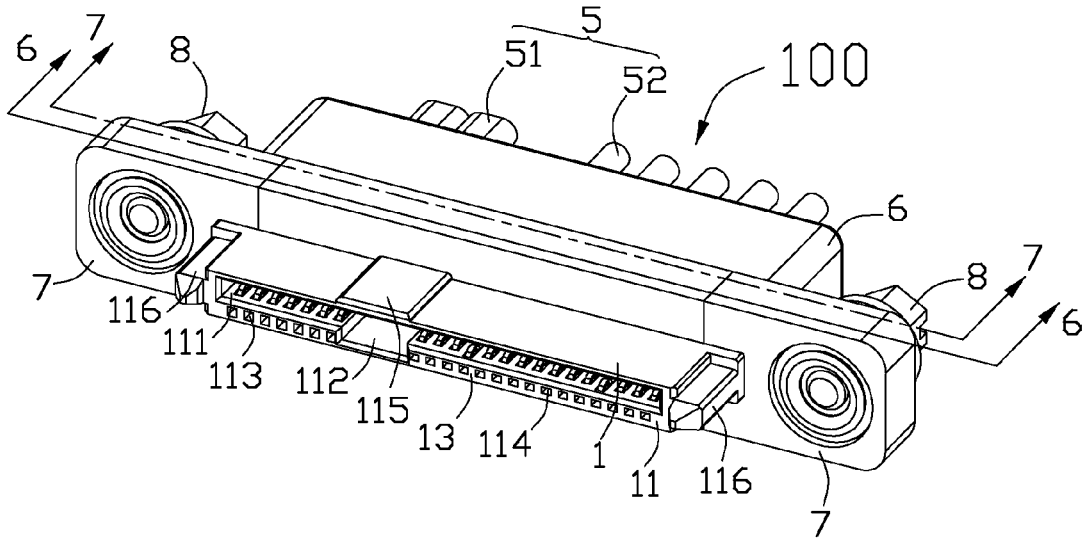
FIG. 1 is an assembled view of the cable assembly.
Figure 2:
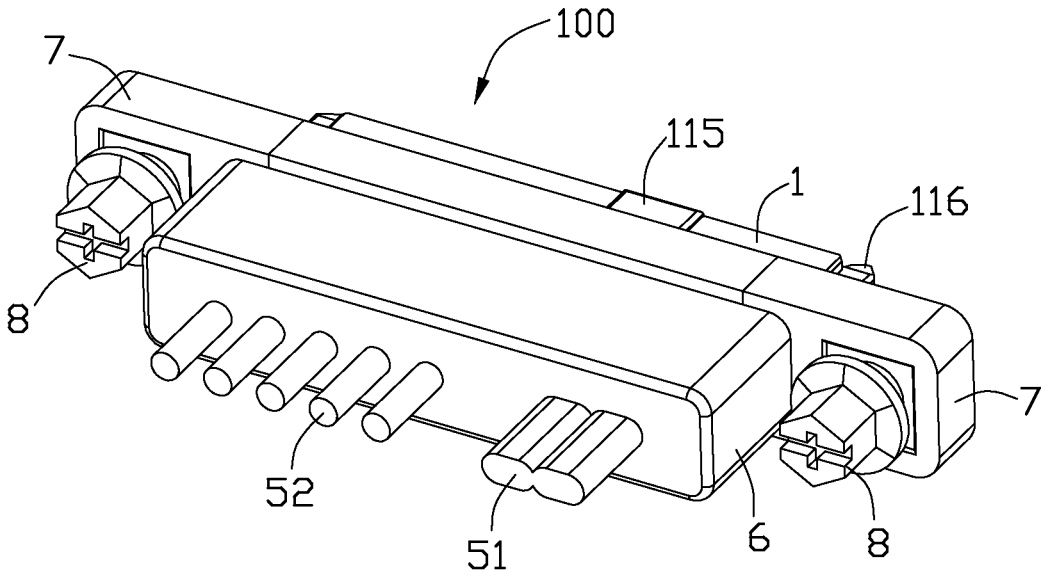
FIG. 2 is another assembled view of the cable assembly shown in FIG. 1.

Reference will now be made to the drawing figures to describe the present invention in detail.

Referring to FIGS. 1-5, a cable assembly 100 in accordance with the present invention comprises an cable end 1 with a front mating cavity 111, a plurality of cable 5 connecting with a rear end of cable end by contacts 2 loaded in the cabled end and a pair of pair of fastening modules 7 removably assembled to lateral ends 15 of the cabled end 1. The cable end 1 comprises an elongated insulative housing 10, the plurality of contacts 2 received in the insulative housing 10, two insulative spacers 3 attached to a rear portion 12 of the housing 10, and a cover 6 overmolded with the housing 10, tail portions 203 of the contacts 2 and front portions 500 of the cables 5. Part of the contacts and the wires join together directly and the rest indirectly join together by a printed circuit board 4.

Referring to FIGS. 1-4 and 6, the insulative housing 10 comprises the rectangular insulative rear portion 12 and a mating portion 11 extending forwardly from the rear portion 12. The mating portion 11 defines a front mating face 13, the mating cavity 111 is depressed from the mating face 13 and a plurality of passageways extending rearwardly through the rear portion 12. A recess 112 is defined on the lower inner side of the mating cavity 111, dividing the passageways into first passageways 113 and second passageways 114. A protrusion 115 is defined on the upper outer side of the mating cavity 111 and is aligned with the recess 112 along an up-and-down direction. The mating portion 11 further defines two guide portions 116 at each of the opposite lateral ends 15 thereof for guiding the cable end connector 100 to mate with a complementary receptacle (not shown). The rear portion 12 further defines a rear face 14 with two separated recesses 141 for receiving the complementary spacers 3. The spacers 3 are defined to seal the passageways 113,114 to prevent the cover material from leaking into the mating cavity 111 during overmolding process. Flanges 121 are formed at upper and lower faces of the mating portion 11 to achieve engagement with the cover 6.

Figure 3:
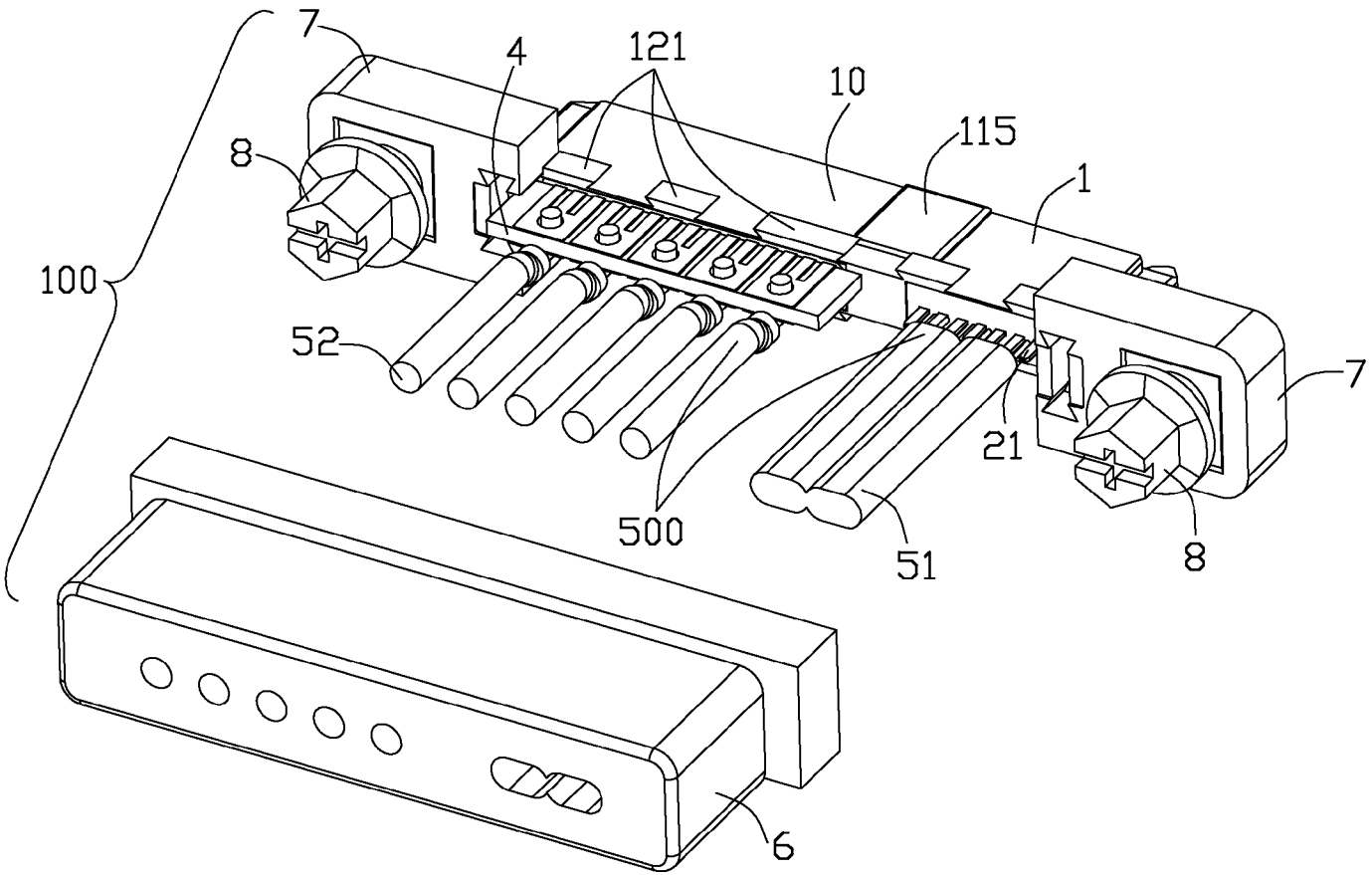
FIG. 3 is an exploded, perspective view of the cable assembly shown in FIG. 2.
Figure 4:
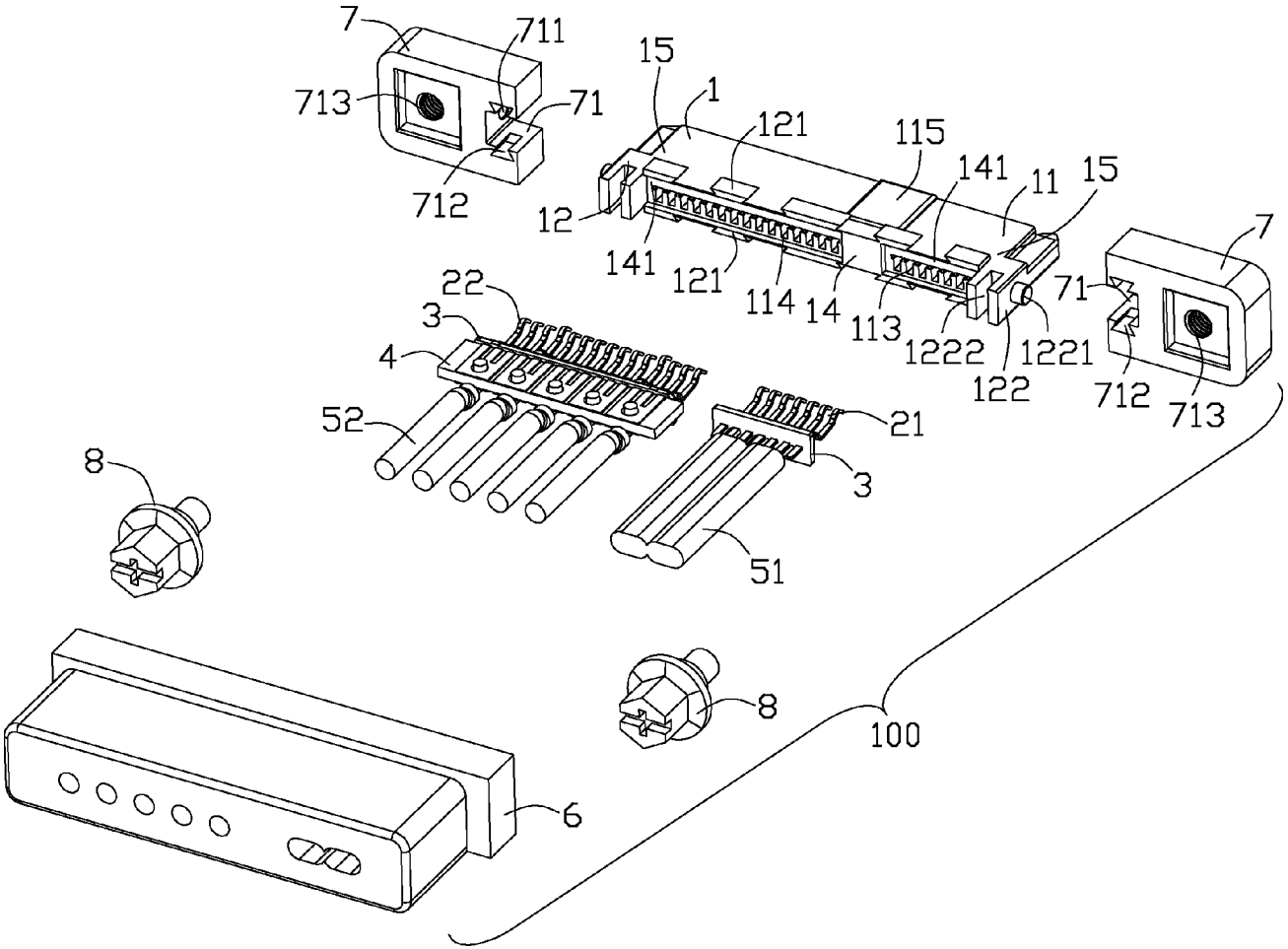
FIG. 4 is a further exploded, perspective view of the cable assembly shown in FIG. 3.
Figure 5:
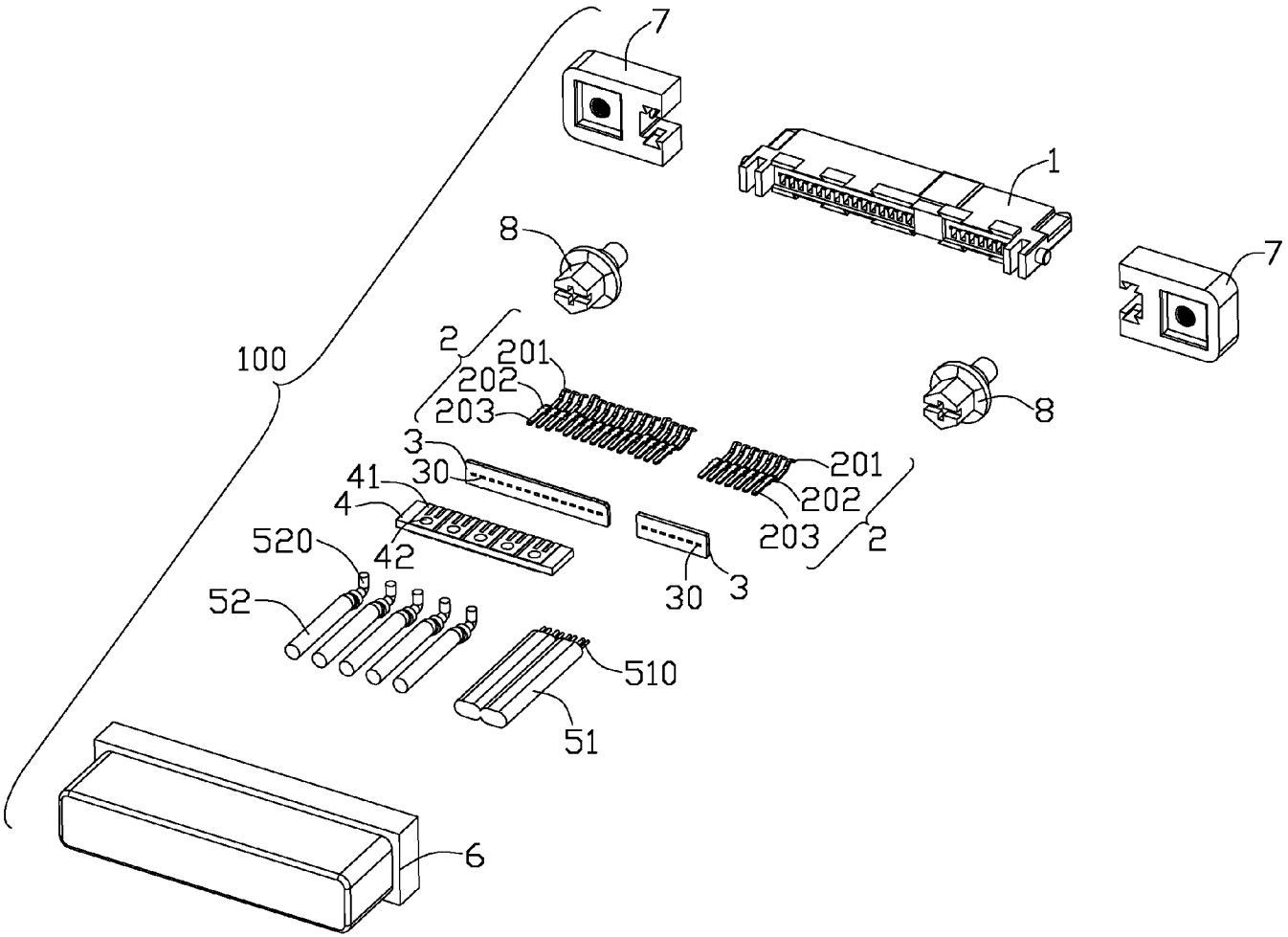
FIG. 5 is a further exploded, perspective view of the cable assembly shown in FIG. 4.
Figure 6:
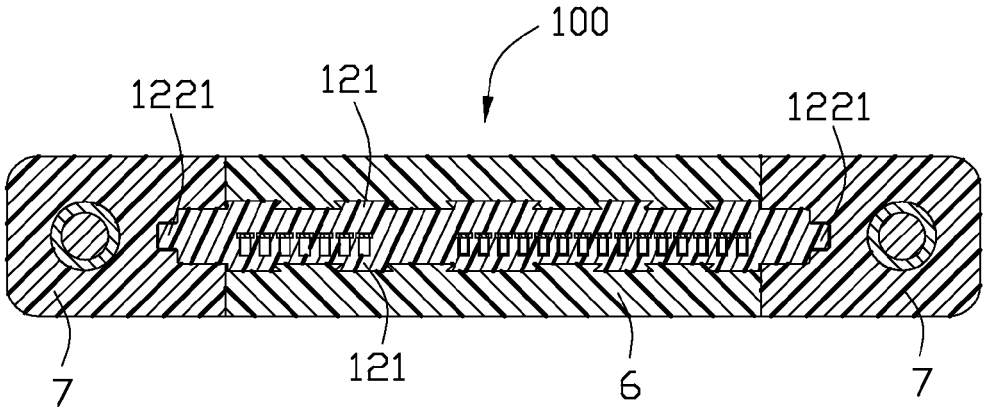
FIG. 6 is a cross-sectional view taken along line 6-6 of FIG. 1.
Figure 7:
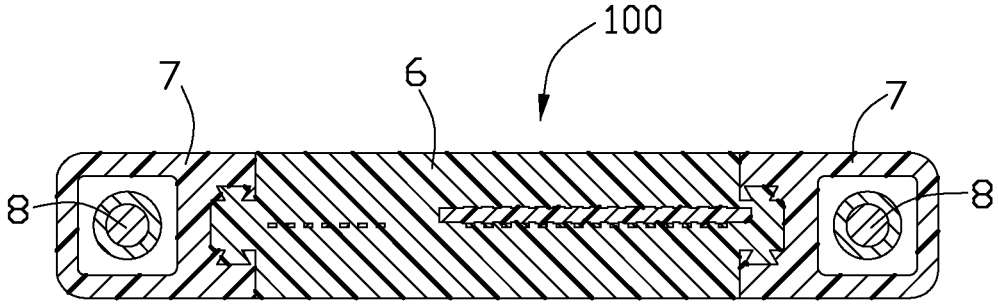
FIG. 7 is a cross-sectional view taken along line 7-7 of FIG. 1.

Referring to FIGS. 3 to 5, each contact 2 comprises a elastic contact portion 201, the plate tail portion 203, and a retention portion 202 connecting the contact portion 201 and the tail portion 203. The contacts 2 are divided into a plurality of first contacts 21 used for transmitting signal and a plurality of second contacts 22 used for transmitting power, which are respectively received in the first passageways 113 and the second passageways 114. A plurality of through holes 30 are formed on the spacers 3 aligning with the passageways 113, 114 such that the tail portions 203 of the contacts can run through the spacers 3 to make electrical connection with the wires. The cables 5 are divided into first cables 51 with a plurality of first wires 510 and second cables 52 with a plurality of second wires 520. Each first wire 510 connects with the tail portion 203 of the first contact 21 directly, while each second wire 520 joins the tail portions 203 of the second contacts 22 through the printed circuit board 4. The printed circuit board 4 forms a number of traces 41 on a front end thereof and a number of wire holes 42 on a rear end (not labeled) thereof. The traces 41 are for soldering with the tail portion 203 of the second contacts 22 and the wire holes 42 are for soldering with corresponding wires.

Referring to FIGS. 3 to 7, A pair of holder portions 122 is integrally formed on opposite lateral ends 15 of the mating portion 11 for mating with the fastening modules 7. Each holder portion 122 forms a post 1221 protruding laterally outward therefrom and a groove 1222 depressed from a rear face of the holder portion for a certain depth and running through the holder portion 122 along the up-and-down direction. Each fastening module 7 defines a securing slot 71 for mating with the holder portion 122, a securing base 713 with a through hole extending along the front-to-back direction for assembling with a fastening member 8. The securing slot 71 further forms a positioning slot 711 according to the post 1221 along the lateral direction (referring to FIG. 6) and a pair of dove-shaped cuts 712 facing to each other along the up-to-down direction (referring to FIG. 7).

Figure 8:
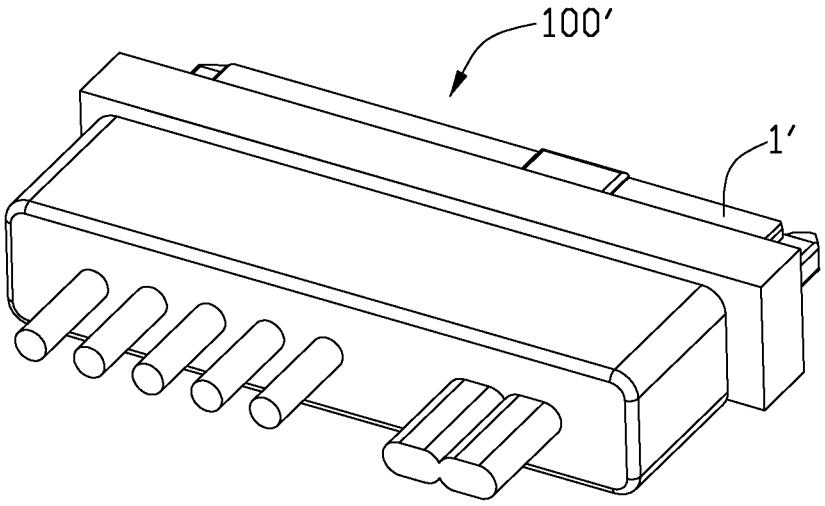
FIG. 8 is an assembled view of the cable assembly shown in FIG. 2 with fastening module removed.
Figure 9:
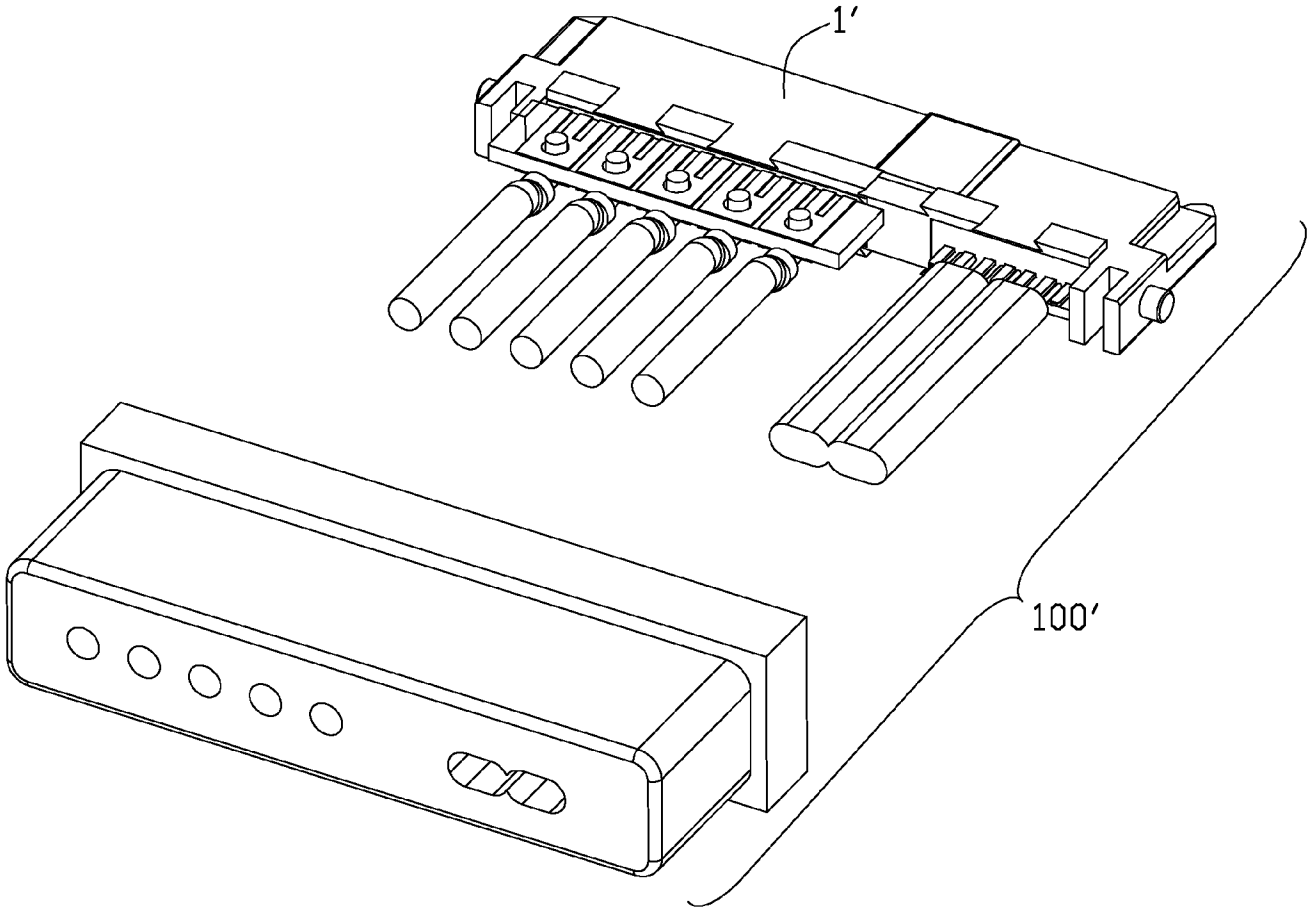
FIG. 9 is an exploded, perspective view of a cable assembly in accordance with the present invention shown in FIG. 8.

During module assembly, the positioning slot 711 of the fastening module 7 is inserted into the post 1221 of the holder portion 122 along the lateral direction and the dove-shaped cuts 712 communicate and align with the groove 1222 after an enough insert distance of the fastening module 7. After electrical connection and module assembly completed, the cover 6 molds over the mating portion 11 of the housing, the spacers 3, the tail portions 203, the circuit board 4 and the wires 510,520 for protecting those components. The pair of fastening modules 7 is also overmolded and secured by the cover 6 for protection. Please referring to FIGS. 8-9 showing a cable assembly 100' has no said fastening module in a condition that the cable assembly is used distinctly without an extra fastening means. It means that the same insulative housing can be used singly or in combination with the fastening modules to meet different applications with different housing structure, which leads to low cost by sharing molds and high mold-using efficiency.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing defining a main base with a mating portion and a holder portion defined on one lateral side of the main base;

a plurality of contacts mounted in the insulative housing;

a fastening module comprising a securing base discretely assembled to the holder portion of the main base along a transversal direction and a fastening member assembled with the securing base along a front-to-back direction perpendicular to the transversal direction; and an insulative cover integrally molded over the insulative housing and the fastening module;

wherein the fastening module defines a securing slot and two cuts respectively communicated with the slot, the holder portion is received into the securing slot and defines a groove formed on a rear surface thereof and throughout top and bottom surfaces thereof, the groove is communicated with the two cuts, a portion of the insulative cover is filled into the groove and two cuts to interconnect the insulative housing and the fastening module.

2. The electrical connector as claimed in claim 1, wherein the mating portion extends forwardly from the base portion, each contact comprises a contact portion received in the mating portion and a tail portion electrically coupling to a plurality of wires directly or indirectly.

3. The electrical connector as claimed in claim 1, wherein a post protrudes laterally outward from the holder portion, a complementary positioning slot is formed on the securing base along the lateral direction, the post is received into the positioning slot when the securing base of fastening module assembled to the holder portion of the main base.

4. The electrical connector assembly as claimed in claim 1, wherein the two cuts are two dove-shaped cuts that face each other along an up-to-down direction.

5. The electrical connector assembly as claimed in claim 1, wherein the electrical connector assembly further comprises a plurality of cables electrically connected with the plurality of contacts.

6. An electrical connector assembly for mating with a complementary connector, comprising:

an insulative housing defining an elongated main base along a transverse direction and adapted to be mated with the complementary connector in a front-to-back direction perpendicular to said transverse direction;

a plurality of contacts disposed in the housing for mating with the complementary connector;

at least one holder portion formed on one transverse end of the main base;

at least one fastening module being configured to be discretely attached to the holder portion along the transversal direction; and an insulative cover integrally molded over the housing and the fastening module; wherein the holder portion and the fastening module are each configured with at least one slot filled with the cover where the housing, the fastening module and the cover are overlapped with one another in both the transverse direction and a vertical direction perpendicular to both the transverse direction and the front-to-back direction for binding all together wherein the slot defined in the holder extends therethrough in the vertical direction, and the slot defined in the fastening module includes a corresponding cutout in alignment with said slot in the vertical direction.

7. The electrical connector assembly as claimed in claim 6, further including a post formed on one of the holder portion and the fastening module, and a hole is formed in the other receiving said post for assembling the fastening module to the holder portion.

8. The electrical connector assembly as claimed in claim 6, wherein the cover further encloses a plurality of wires which are mechanically and electrically connected to the corresponding contacts.

9. The electrical connector assembly as claimed in claim 6, wherein there are two said holder portions located at two opposite transverse ends of the housing, respectively, and the cover fills a space therebetween in the transverse direction.

10. An electrical connector assembly for mating with a complementary connector, comprising:

an insulative housing defining an elongated main base along a transverse direction and adapted to be mated with the complementary connector in a front-to-back direction perpendicular to said transverse direction;

a plurality of contacts disposed in the housing for mating with the complementary connector;

at least one holder portion formed on one transverse end of the main base;

at least one fastening module being configured to be discretely attached to the holder portion; and an insulative cover integrally molded over the housing and the fastening module; wherein the fastening module defines a securing slot, and the holder portion defines a groove disposed in said securing slot, and a portion of the cover is filled within both the groove and the securing slot outside of the groove where the housing, the fastening module and the cover are overlapped with one another in both the transverse direction and a vertical direction perpendicular to both the transverse direction and the front-to-back direction for binding all together; wherein said groove extends in the vertical direction and is open at a top and a bottom, wherein the securing slot defines a pair of cuts outside the groove and aligned with the top and bottom in the vertical direction.

11. The electrical connector assembly as claimed in claim 10, wherein said fastening module is configured to be assembled to the holder portion in said transverse direction.

* * * * *